US006129138A

United States Patent [19]

Gartland

[11] Patent Number: 6,129,138

[45] Date of Patent: Oct. 10, 2000

[54] METHOD OF MAKING A CERAMIC SHELL MOULD AND A METHOD OF CASTING

[75] Inventor: Michael W Gartland, Nottingham, United Kingdom

[73] Assignee: Rolls-Royce plc, London, United Kingdom

[21] Appl. No.: 09/257,004

[22] Filed: Feb. 25, 1999

[30] Foreign Application Priority Data

Mar. 14, 1998 [GB] United Kingdom ..... 9805371

[51] Int. Cl.[7] ..... B22C 7/02; B22C 9/04

[52] U.S. Cl. ..... 164/516; 35/44

[58] Field of Search ..... 164/35, 44, 516

[56] References Cited

U.S. PATENT DOCUMENTS 4,651,801 3/1987 Sasaki .

FOREIGN PATENT DOCUMENTS 995722 6/1965 United Kingdom .
1196533 6/1970 United Kingdom .
2068818 8/1981 United Kingdom .
2165482 4/1986 United Kingdom .

*Primary Examiner*—Kuang Y. Lin
*Attorney, Agent, or Firm*—W. Warren Taltavull; Farkas & Manelli PLLC

[57] ABSTRACT

A wax pattern assembly (10) is removed from a ceramic shell mould (30) by removing a support member (20) from the wax pattern assembly (10). The ceramic shell mould (30) is then heated to melt the wax out of the ceramic shell mould (30). The removal of the support member (20) provides a cavity (22) into which the wax may expand without cracking the ceramic shell mould (30). The support member (20) is provided with an external thread to allow it to be easily removed from the wax pattern assembly (10).

22 Claims, 2 Drawing Sheets

METHOD OF MAKING A CERAMIC SHELL MOULD AND A METHOD OF CASTING

BACKGROUND OF THE INVENTION

The present invention relates generally to a method of making a ceramic shell mould, particularly investment casting ceramic shell moulds and to a method of casting, particularly investment casting.

In investment casting, or lost wax casting process, a wax pattern of component, or article, is produced. The wax pattern is a replica of the component, or article, to be produced. Usually a number of wax patterns are assembled together on a wax runner to form a wax pattern assembly. Usually the wax runner is formed on a support member. The wax pattern assembly is immersed in a liquid ceramic slurry which quickly gels after draining, strengthening refractory granules are sprinkled over the ceramic slurry covered wax pattern assembly and the refractory granules bond to the slurry coating to produce a ceramic layer on the wax pattern assembly. This process is repeated several times to produce many ceramic layers which form the ceramic shell mould. The mould is dried and then heated so as to melt the wax pattern assembly such that the wax may run out of the mould to define an internal cavity identical in shape to the wax pattern assembly. The ceramic material is then fired to complete the ceramic shell mould. A suitable molten material, for example a metal, alloy, superalloy or intermetallic may then be cast in the ceramic shell mould.

It is well known that the investment casting process suffers a particular disadvantage in that when the ceramic coated wax pattern assembly is heated to remove the wax, the wax expands at a greater rate than the support member and ceramic shell mould. As a result of this differential thermal expansion, the ceramic shell mould sometimes cracks and this either renders the mould useless, or alternatively small fragments of the ceramic shell mould become entrained in the molten material and subsequently becomes lodged in the cast article and this may result in the article being deemed useless.

The use of waxes with lower melting points has been suggested as a way to overcome the problem, but this has not completely overcome the problem. The use of resilient portions in, or on, the wax runner portions as described in UK patent No. GB2068818A has also been suggested, but this does not completely overcome the problem.

SUMMARY OF THE INVENTION

The present invention seeks to provide a method of making a ceramic shell mould which overcomes the above mentioned problems.

Accordingly the present invention provides a method of making a ceramic shell mould which comprises the steps of:

(a) making at least one disposable pattern and an interconnecting disposable runner portion by forming the disposable runner portion around a support member, (b) coating the disposable pattern and disposable runner portion with ceramic material to form a mould, (c) removing the support member from the disposable runner portion to form a cavity in the disposable runner portion by relatively rotating the support member and the disposable runner portion to form the cavity, (d) heating the mould, disposable pattern and disposable runner to remove the disposable pattern and disposable runner from the mould, and (e) firing the mould to complete the ceramic shell mould.

Preferably the support member is a metal member. Preferably the support member has a threaded portion to enable the support member to be removed from the disposable runner portion. Preferably the support member has an end portion, the end portion has a larger diameter than the remainder of the runner portion. Preferably the threaded portion is on the end portion. Preferably the end portion has a recess to enable drive means to provide the relative rotation between the support member and the disposable runner portion. Preferably the support member is tapered.

Preferably step (a) comprises making a plurality of disposable patterns and an interconnecting disposable runner portion.

Preferably step (a) comprises making the at least one disposable pattern and disposable interconnecting runner portion from wax.

Preferably step (a) comprises coating the support member with a lubricant before forming the disposable runner portion around the support member. Preferably the lubricant comprises a thixotrope.

The present invention also seeks to provide a method of casting which overcomes the above mentioned problems.

Accordingly the present invention provides a method of casting which comprises the steps of:

(a) making at least one disposable pattern and an interconnecting disposable runner portion by forming the disposable runner portion around a support member, (b) coating the disposable pattern and disposable runner portion with ceramic material to form a mould, (c) removing the support member from the disposable runner portion to form a cavity in the disposable runner portion by relatively rotating the support member and the disposable runner portion to form the cavity, (d) heating the mould, disposable pattern and disposable runner to remove the disposable pattern and disposable runner from the mould, (e) firing the mould to complete the ceramic shell mould, (f) pouring molten material into the ceramic shell mould and solidifying the molten material in the ceramic shell mould.

Preferably the support member is a metal member. Preferably the support member has a threaded portion to enable the support member to be removed from the disposable runner portion. Preferably the support member has an end portion, the end portion has a larger diameter than the remainder of the runner portion. Preferably the threaded portion is on the end portion. Preferably the end portion has a recess to enable drive means to provide the relative rotation between the support member and the disposable runner portion. Preferably the support member is tapered.

Preferably step (a) comprises making a plurality of disposable patterns and an interconnecting disposable runner portion.

Preferably step (a) comprises making the at least one disposable pattern and disposable interconnecting runner portion from wax.

Preferably step (a) comprises coating the support member with a lubricant before forming the disposable runner portion around the support member. Preferably the lubricant comprises a thixotrope.

The present invention will be more fully described by way of example with reference to the accompanying drawing, in which:

DETAILED DESCRIPTION OF THE DRAWINGS

Figure 1:
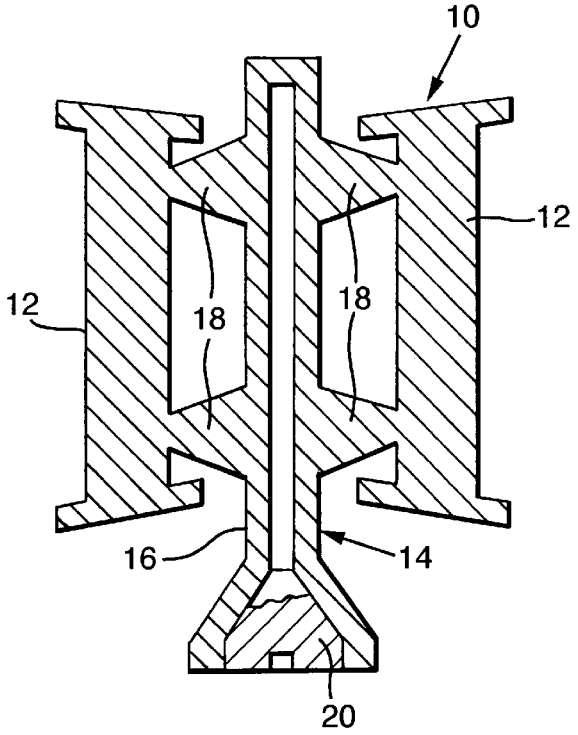
FIG. 1 is a cross-sectional view through a disposable pattern assembly and a support member.

A wax pattern assembly 10, shown in FIG. 1, comprises a plurality of wax patterns 12 suitable for making turbine blades or turbine vanes for gas turbine engines. The wax patterns 12 are arranged on a wax runner 14, the wax runner 14 comprises a first portion 16 and a plurality of second portions 18. The wax patterns 12 are arranged around the first portion 16 of the wax runner 14 and the second portions 18 interconnect the first portion 16 and the wax patterns 12. The first portion 16 of the wax runner 14 is formed around a support member 20 which gives strength to the wax pattern assembly.

Figure 2:
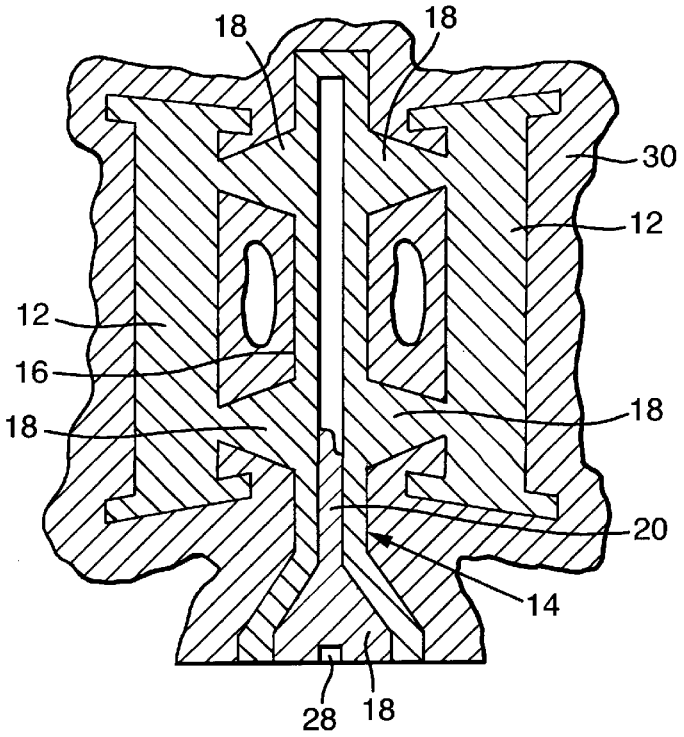
FIG. 2 is a cross-sectional view through the disposable pattern assembly of FIG. 1 after coating in a ceramic material to form a ceramic shell mould.

The wax pattern assembly 10, including the wax patterns 12, is immersed in liquid ceramic slurry and has refractory granules sprinkled on the gelling liquid ceramic slurry to produce a layer of ceramic. The process of immersing the wax pattern assembly 10 in liquid ceramic slurry and sprinkling with refractory granules is repeated until the thickness of ceramic is sufficient for the particular application. The thickness of ceramic normally used is 6 mm to 12 mm. The ceramic shell 30, shown in FIG. 2, still has the wax pattern assembly 10.

Figure 3:
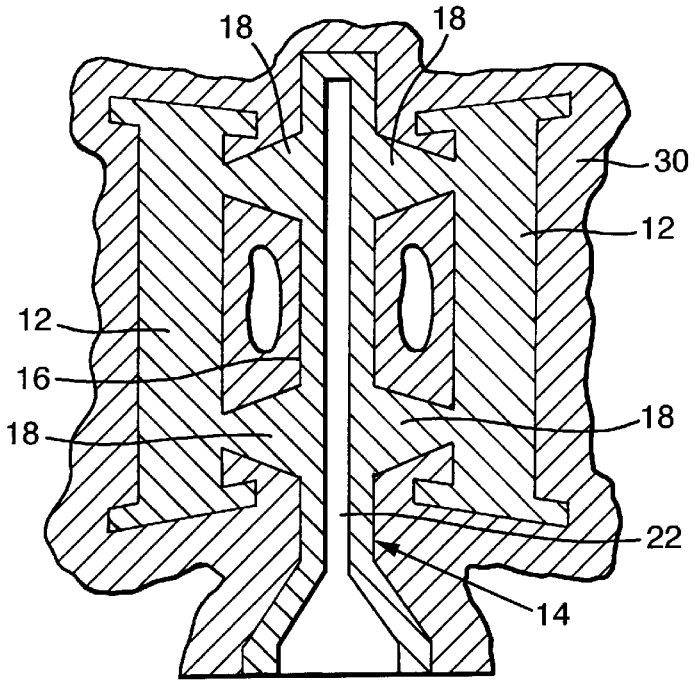
FIG. 3 is a cross-sectional view through the disposable pattern assembly and ceramic shell mould after removal of the support member.
Figure 4:
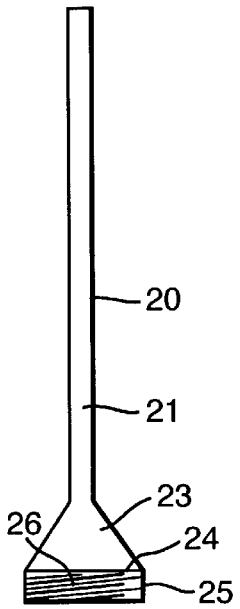
FIG. 4 is a view of the support member shown in FIGS. 1 and 2.

The wax pattern assembly 10 is removed by inverting the ceramic shell mould 30 and by heating the ceramic shell mould 30 such that the wax melts and runs out of the ceramic shell mould 30. Before the ceramic shell mould 30 is heated the support member 20 is removed from the first portion 16 of the wax runner 14. This forms a cavity 22 within the first portion 16 of the wax runner 14, as shown in FIG. 3. During the heating of the ceramic shell mould 30, the cavity 22 provides a space for the wax to expand into and hence reduces, or minimises the possibility of the ceramic shell mould cracking due to the differential thermal expansion between the ceramic shell mould 30 and the wax pattern assembly 14. Thus this reduces the possibility of the ceramic shell moulds 30 being rendered useless and reduces the possibility of fragments of the ceramic shell mould 30 being entrained in the molten metal and subsequently lodged into the cast component, or article, and rendering the cast components useless.

After the wax pattern assembly 14 has been removed from the ceramic shell mould 30 the ceramic shell mould 30 is fired to cure the ceramic shell mould 30. The ceramic shell mould 30 is then transferred to a casting furnace and molten metal is poured into the ceramic shell mould 30. The molten metal is then allowed to cool and to solidify in the ceramic shell mould 30. Finally the ceramic shell mould 30 is removed to leave the cast components, or articles.

The ceramic shell moulds may be used for casting superalloys, alloys and intermetallics for example cobalt, nickel or iron superalloys, titanium aluminides, nickel aluminides etc. It may also be possible to cast other materials in the ceramic shell moulds.

The ceramic shell moulds may also be arranged to allow directional solidification and single crystal casting.

The support member 20 used in the wax pattern assembly 14, in this example is provided, at a first end 24, with a conical portion 23 which leads to a larger diameter portion 25. The surface of the larger diameter portion 25 is provided with a helical thread 26 and the first end 24 is provided with a triangular slot 28, square slot, a rectangular slot, or a cruciform slot or a slot of other suitable shape to receive a driving tool.

A driving tool is placed in the slot 28 and the tool is arranged to rotate the support member 20 relative to the ceramic shell mould 30 such that the support member 20 unthreads itself from the wax pattern assembly 10 due to the threads 26 on the support member 20. This allows the support member 20 to be removed easily from the wax pattern assembly 10.

In order to further aid removal of the support member 20 from the wax pattern assembly 10 the main portion 21 of the support member 20 tapers away from the first end 24 to a smaller diameter.

A further aid for removal of the support member 20 from the wax pattern assembly 10 is to provide a coating of lubricant on the support member 20 before the first portion 16 of the wax pattern assembly 10 is formed around the support member 20. The lubricant preferably comprises a thixotrope, which changes from a solid to a liquid when pressure is applied, to further aid removal of the support member 20.

Preferably the lubricant comprises 5–10% thixotrope and the remainder is silica fluid, for example 5.5% bentonite gel and the remainder silica fluid.

The advantages of the invention are that the time for removing the support member from the wax pattern assembly is greatly reduced to about 30 seconds, the removing of the support member from the wax pattern assembly produces no mess, ie the wax is not melted. Additionally, when using tapered large diameter support members less wax is required in the wax pattern assembly and therefore the time for subsequently removing the wax from ceramic shell mould is reduced.

The support member 20 is preferably a metal, for example aluminium etc.

Although the invention has described wax pattern assemblies it may be possible to use other disposable materials to form the pattern assemblies.

Although the invention has referred to a wax pattern assembly having a support member which is removed before dewaxing to provide a cavity for expansion of the wax, it may be that the wax pattern assembly does not have a support member and it may be possible to form a cavity in the wax pattern assembly by other means such as by drilling into the wax pattern assembly.

What is claimed is:

1. A method of making a ceramic shell mould which comprises the steps of:

(a) making at least one disposable pattern and an interconnecting disposable runner portion by forming the disposable runner portion around a support member, (b) coating the disposable pattern and disposable runner portion with ceramic material to form a mould, (c) removing the support member from the disposable runner portion to form a cavity in the disposable runner portion by relatively rotating the support member and the disposable runner portion to form the cavity, (d) heating the mould, disposable pattern and disposable runner to remove the disposable pattern and disposable runner from the mould, and (e) firing the mould to complete the ceramic shell mould.

2. A method as claimed in claim 1 comprising forming a threaded portion on the support member to enable the support member to be removed from the disposable runner portion.

3. A method as claimed in claim 2 wherein the support member has an end portion, providing the end portion with a larger diameter than the remainder of the runner portion.

4. A method as claimed in claim 3 wherein the threaded portion is on the end portion.

5. A method as claimed in claim 3 or claim 4 comprising providing a recess in the end portion to enable drive means to provide the relative rotation between the support member and the disposable runner portion.

6. A method as claimed in claim 1 wherein the support member is a metal member.

7. A method as claimed in claim 1 wherein the support member is tapered.

8. A method as claimed in claim 1 wherein step (a) comprises making a plurality of disposable patterns and an interconnecting disposable runner portion.

9. A method as claimed in claim 1 wherein step (a) comprises making the at least one disposable pattern and disposable interconnecting runner portion from wax.

10. A method as claimed in claim 1 wherein step (a) comprises coating the support member with a lubricant before forming the disposable runner portion around the support member.

11. A method as claimed in claim 10 wherein the lubricant comprises a thixotrope.

12. A method of casting which comprises the steps of:

(a) making at least one disposable pattern and an interconnecting disposable runner portion by forming the disposable runner portion around a support member, (b) coating the disposable pattern and disposable runner portion with ceramic material to form a mould, (c) removing the support member from the disposable runner portion to form a cavity in the disposable runner portion by relatively rotating the support member and the disposable runner portion to form the cavity, (d) heating the mould, disposable pattern and disposable runner to remove the disposable pattern and disposable runner from the mould, (e) firing the mould to complete the ceramic shell mould, (f) pouring molten material into the ceramic shell mould and solidifying the molten material in the ceramic shell mould.

13. A method as claimed in claim 12 comprising forming a threaded portion on the support member to enable the support member to be removed from the disposable runner portion.

14. A method as claimed in claim 13 wherein the support member has an end portion, providing the end portion with a larger diameter than the remainder of the runner portion.

15. A method as claimed in claim 14 wherein the threaded portion is on the end portion.

16. A method as claimed in claim 15 comprising providing a recess in the end portion to enable drive means to provide the relative rotation between the support member and the disposable runner portion.

17. A method as claimed in claim 12 wherein the support member is a metal member.

18. A method as claimed in claim 12 wherein the support member is tapered.

19. A method as claimed in claim 12 wherein step (a) comprises making a plurality of disposable patterns and an interconnecting disposable runner portion.

20. A method as claimed in claim 12 wherein step (a) comprises making the at least one disposable pattern and disposable interconnecting runner portion from wax.

21. A method as claimed in claim 12 wherein step (a) comprises coating the support member with a lubricant before forming the disposable runner portion around the support member.

22. A method as claimed in claim 21 wherein the lubricant comprises a thixotrope.

* * * * *